US006727447B2

(12) United States Patent
Hentunen

(10) Patent No.: US 6,727,447 B2
(45) Date of Patent: Apr. 27, 2004

(54) RESISTANT INTEGRATED KEYPAD AND A METHOD FOR MAKING THE SAME

(75) Inventor: Kari Hentunen, Aura (FI)

(73) Assignee: Nokia Corporation, Espoo (FI)

( * ) Notice: Subject to any disclaimer, the term of this patent is extended or adjusted under 35 U.S.C. 154(b) by 0 days.

(21) Appl. No.: 10/171,612

(22) Filed: Jun. 17, 2002

(65) Prior Publication Data

US 2002/0190875 A1 Dec. 19, 2002

(30) Foreign Application Priority Data

Jun. 19, 2001 (FI) ..... 20011304

(51) Int. Cl.[7] ..... H01H 13/70

(52) U.S. Cl. ..... 200/302.2; 200/341; 200/5 A; 200/343

(58) Field of Search ..... 299/622; 200/5 A, 200/511, 512, 517, 341–345, 302.1, 302.2, 302.3; 400/490, 491, 491.2, 495, 495.1, 496; 29/62

(56) References Cited

U.S. PATENT DOCUMENTS 4,032,729 A * 6/1977 Koistinen ..... 200/5 A
4,128,744 A * 12/1978 Seeger ..... 200/5 A
4,190,748 A * 2/1980 Langford ..... 200/5 A
4,323,740 A * 4/1982 Balash ..... 200/5 A
4,613,736 A * 9/1986 Shichijo et al. ..... 200/317
6,023,033 A 2/2000 Yagi et al. ..... 200/512
6,046,019 A 4/2000 Goumeniouk et al. ..... 435/28
6,462,291 B1 * 10/2002 Sachs ..... 200/302.2

OTHER PUBLICATIONS

Finnish Search Report, May 15, 2002.

* cited by examiner

*Primary Examiner*—Michael A. Friedhofer
(74) *Attorney, Agent, or Firm*—Antonelli, Terry, Stout & Kraus, LLP

(57) ABSTRACT

Method and apparatus for keypads with push buttons and in particular to integrating different parts of a keypad to provide better and more secure functioning. The keypad includes a first component including a cover portion and a key portion forming together a single structural entity, the structural entity allowing the key portion to move within a limited range in relation to the cover portion; and a substantially soft second component attached to the first component for covering space between the cover portion and the key portion of the first component and making composed compound construction substantially tight, still allowing the limited movement of the key portion of the first component.

18 Claims, 3 Drawing Sheets

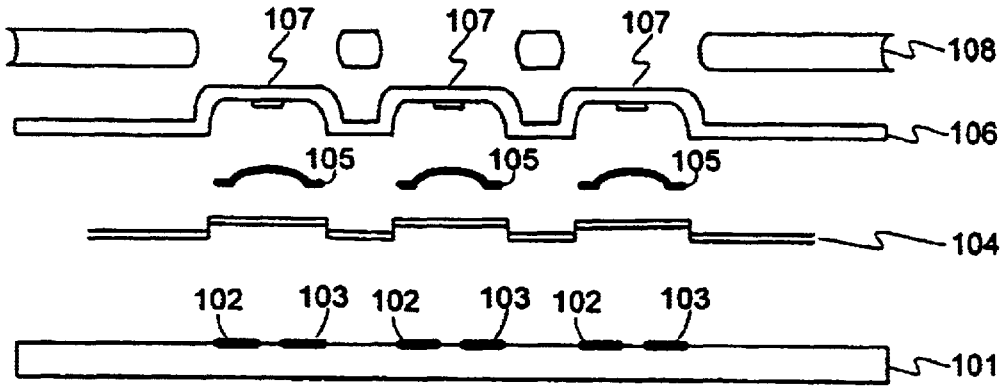
Fig. 1a Prior Art
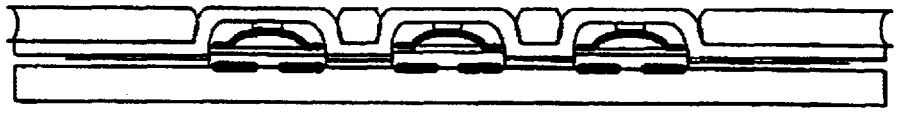
Fig. 1b Prior Art

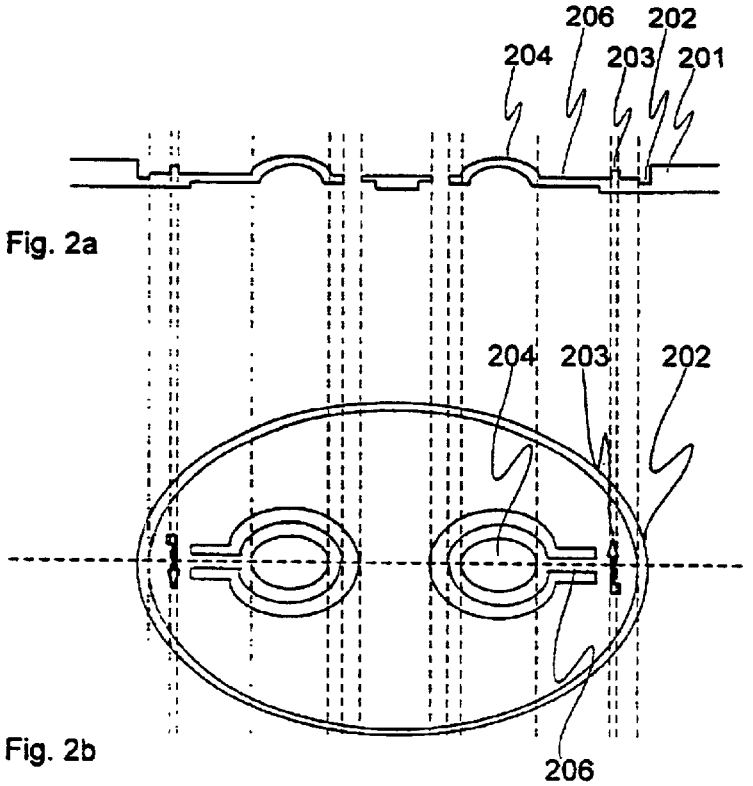
Fig. 2a
Fig. 2b
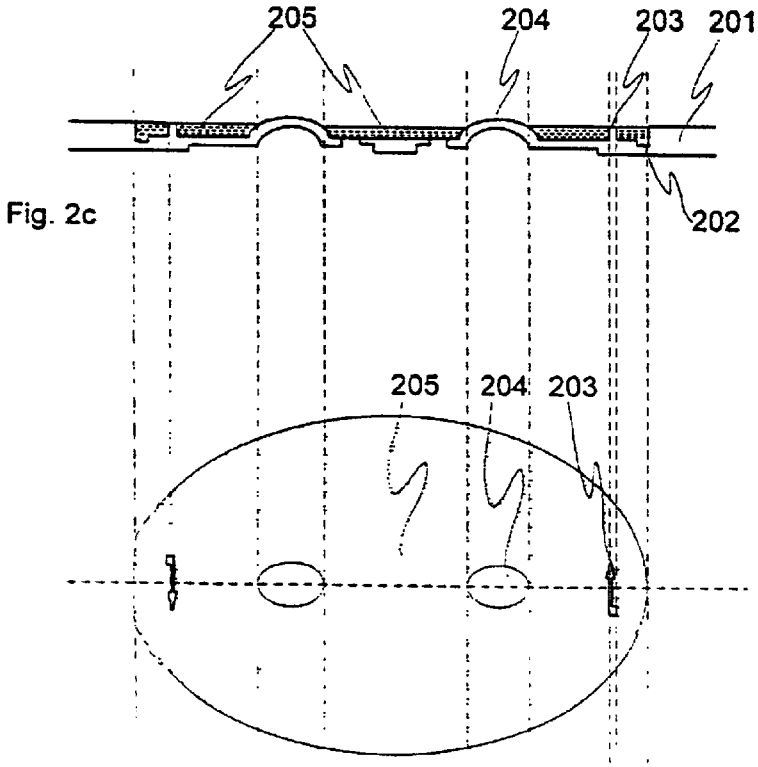
Fig. 2c
Fig. 2d

RESISTANT INTEGRATED KEYPAD AND A METHOD FOR MAKING THE SAME

TECHNICAL FIELD

This invention relates to keypads with push buttons and in particular to integrating different parts of a keypad to provide better and more secure functioning.

BACKGROUND OF THE INVENTION

The known keypads in portable electronic devices comprise a cover portion and different key portions. These two separate parts are located so that the key portion comes through the cover portion. The keytops, which are situated outward from the cover, move into an inward direction with respect to the cover when pressed. This provides tactile feedback to user. Another important thing for the user is that each key is identified by printing some markings or characters on the outer surface of a key or by embossing the flexible cover to create raised areas at or around the keytop locations.

FIG. 1*a* is a sectional exploded view, which illustrates a known structure of a keypad. These kinds of keypads are used for example in mobile telephones and personal digital assistants. The upper surface of a printed circuit board 101 comprises a number of contact areas, where at least two conductive strips 102 and 103 come close to each other. Supported over the printed circuit board 101 and separated from it by a perforated insulation layer 104 is an array of conductive domes 105 so that each conductive dome 105 lies directly above the conductive strips 102 and 103. Key mat 106 is located on top of the conductive domes. It is made of an elastic material. A bulging protrusion 107 of the key mat protrudes slightly out through the holes in the outer cover 108. In some keypads hard key-specific parts are used above the bulging protrusions 107 to provide a harder tactile feeling for the user (not shown in FIG. 1). FIG. 1*b* shows the same structure in assembled configuration.

A cover portion 108 is the outer part of the structure in FIGS. 1*a* and 1*b*. In these figures the key mat 106 and the bulging protrusions 107 form a key portion. The rest of the structure, a printed circuit board 101, conductive strips 102, 103, a perforated insulation layer 104 and conductive domes 105 form the actual electrically functioning part of the keyboard.

One problem with prior art keypad is printing desired markings or characters on the surface of each key. Such printing operation should be performed directly on the surface of the each individual key or button. These buttons have substantially cubic configuration. This kind of printing operation is complex and less efficient compared to the printing operation in which a marking or the like is directly printed on a sheet. It is also difficult to perform a fine printing. Also it is noted that, when a plurality of keys are simultaneously printed with a marking, misregistration between the keytops and a printing means would occur, since the keytop plate has flexibility. As a result, simultaneous printing of a marking or the like on number of keytops is impossible. This reduces the efficiency of the printing operation.

Another unsolved problem of the prior art solutions raises from the fact that there must be an interstice between the key portion and the cover portion for the keytop to be able to move. The final product should be as compact as possible, so the interstice between the key portion and the cover portion should be kept small. Advantageously this interstice should be smaller than 0.5 mm. On the other hand in the mould there must be accomplished a closing surface to the interstice. This provides that the cover should be thicker than 0.5 mm.

In the publication U.S. Pat. No. 6,064,019 there has been introduced a resilient switch cover and an actuator button compactly installed through the aperture in the cover. Compactness of the solution of this patent is based on the size of the button, which is larger in diameter than a corresponding diameter of the aperture in the cover.

In the publication U.S. Pat. No. 6,023,033 there has been described a method for producing a keytop plate. In this solution the keytops are formed by moulding a resin at the predetermined positions of a synthetic resin film. A moulded elastomer plate is attached to formed keytops. The waterproofing capability of this construction is based on the fact that in the area of the moulded elastomer plate, other than the areas to which the keytops are attached, there are no through-holes.

It is also known by the prior art to isolate a separate key by some soft substance. All prior art solutions are generated with number of separate manufacturing steps, which often require number of different moulds and intermediate storages. These different production steps are usually expensive and inefficient.

SUMMARY OF THE INVENTION

The object of the present invention is to overcome the drawbacks of the prior art. A further object of the present invention is to simplify the manufacturing and to produce a compact keypad resistant against harmful environmental effects.

The objects of the invention are achieved by integrating the key portion to the cover portion. This new configuration packs the keys and the cover to one solid and essentially rigid portion, which is manufactured in a limited number of steps. Further a soft component is attached to the rigid component to make the construction resistant against harmful environmental effects.

The invention is directed towards the features of the keypad, which are described in the independent claims. According to the present invention the keypad is characterized in that it comprises a first component including a cover portion and a key portion that form together a single structural entity so that said structural entity allows the key portion to move within a limited range in relation to the cover portion; and a substantially soft second component, which is attached to the first component for covering space between the cover portion and the key portion of the first component and making composed compound construction substantially tight, still allowing the limited movement of the key portion of the first component.

According to the present invention there is produced a rigid component, which includes a cover portion and a key portion, and a soft component, which makes the configuration tight. The different structures in the rigid component are generated by components having certain mechanical characters. For example in fixed, hard parts there is simply a thicker material layer while in flexible parts a thin layer is used. Also in the mechanical construction different shapes are used knowing the fact that planar structures can be used in flexible parts of the component, whereas for the hard, rigid parts for example a cubic-like or dome structure would be more appropriate. The soft component is attached to the rigid component either mechanically or chemically.

The new compact construction introduced in the present invention is easier and cheaper to manufacture, because the rigid component can be moulded in one mould. The whole structure can be generated with a conventional mould without any moving parts. This has the further advantage that also the manufacturing process is stable, so it includes less variables and can be carried out effectively.

In the keypad structure of the present invention, there is a certain interstice between the keytop and the cover, although these parts are made as one rigid component.

The soft component covers the interstice and makes the structure compact. The soft component so prevents dirt and dust from penetrating inside the structure, as dirt and dust might otherwise cause a key to stick or not to function properly. All these kind of problems are solved by the present invention. Also with the proper choice of the materials and substrates water resistance may be achieved.

The tactile characteristics of this new construction make the use of the product comfortable. If the whole keypad would be made of flexible material, the tactile feeling and feedback would remain relatively soft. A hard tactile feeling, which is preferable to most users, may be provided by a moulded construction introduced here. With a harder tactile feeling the user can be more secure about her/his selections. The more the depth-directional movement is needed, the more there must be space surrounding the moving parts either in vertical or horizontal direction.

The graphics or, in the other words, printing markings and characters on the pushbuttons, may be carried out easily with this new construction presented in this invention. Now graphics can be implemented even in the mould, and/or printing operations can either be done straight on the key made of rigid component or to the soft component area.

BRIEF DESCRIPTION OF DRAWINGS

The present invention is described in detail with the accompanying drawings.

FIG. 1*a* illustrates a known keypad structure in exploded view,

FIG. 1*b* illustrates the keypad structure of FIG. 1*a* in assembled configuration, FIG. 2*a* illustrates the embodiment of the present invention, where the rigid component is seen from a side, FIG. 2*b* illustrates the embodiment of the present invention, where the rigid component is seen from the overhead view, FIG. 2*c* illustrates the embodiment of the present invention, where the soft component is seen from a side, FIG. 2*d* illustrates the embodiment of the present invention, where the soft component is seen from the overhead view.

DETAILED DESCRIPTION OF THE INVENTION

Figure 3:
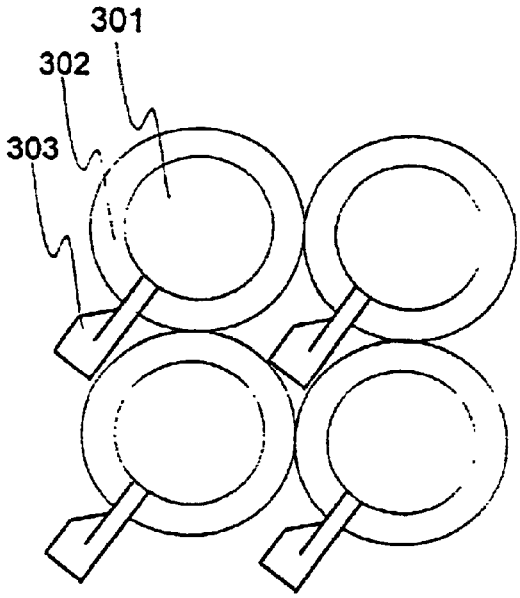
FIG. 3 illustrates a moulded keypad with number of keys according to one advantageous embodiment of the invention.

In the following description of the various embodiments, reference is made to the accompanying drawings, which form a part hereof, and in which is shown by way of illustration various embodiments in which the invention may be practiced. It is to be understood that other embodiments may be utilized, and structural and functional modifications may be made without departing from the scope of the present invention.

FIG. 2*a* is a cross-sectional side view of a certain part of a keypad, which constitutes, according to the present invention, the so-called rigid component. In FIG. 2*a* the key 204 is attached to the cover portion 201. The protrusion 203 illustrates a graphic or some mark, which is to be on the final surface plane after a certain soft component has been injected as will be described later with the accompanying FIG. 2*c*. A groove 202 is advantageous, if the soft component is to be attached mechanically to the rigid component, since with a groove 202 the mechanical joint can be made compact, but still demountable. The attaching soft component has a counterpart, which fits tight to the groove 202, because of the elasticity and a shape of the soft part. The same effect may be illustrated so that, instead the grooves, the rigid component has protrusions and the soft component has holes with smaller diameter than protrusions aligned with them. FIG. 2*b* shows the same one-component structure from the overhead view. There is the groove for the mechanical connection 202, the key, or the pushbutton 204 and the protrusion 203, which in this exemplary embodiment, as can be seen from the FIG. 2*b*, is a graphical arrow.

FIG. 2*c* illustrates the corresponding keypad after the soft component has been injected. In FIG. 2*c* the basic structure is the same as described in the previous FIG. 2*a*. Made of rigid component there is a cover portion 201, groove 202 for a mechanical joint, protrusion 203, which implements graphics and finally the key 204. The soft component 205 is injected on the top of the rigid component structure. The soft component 205 binds the pieces of the rigid component to one compact construction. Also the soft component 205 makes the surface of the construction flat still enabling the movement of the keys. This soft component structure is seen from the overhead view in FIG. 2*d*. As can be seen in FIG. 2*c* the upper surface is now substantially flat. Only the keys 204 protrude upwards from the surface. The graphics 203 are at the same level as the injected soft component surface 205. The possible groove 202 is also filled with the soft component.

In this application the two used components are named as rigid component and soft component. The term rigid component is used in this application to convey that the material is substantially hard, or in a substantially hard form. So the selected material is to be fast and solid. This means that in parts where no specifically provided, relatively thin and elongated portions exist, the rigid component itself does not bend. Limited elasticity can still be achieved by designing the mechanical construction of the component to include certain relatively thin and elongated portions. So small movements are allowed even if the component is called rigid. The term soft component is used in this application to convey that the material is substantially flexible and elastic, or in a substantially flexible or elastic form. This soft component covers unwanted gaps tightly and conforms to a movement of the surrounding parts. These features maintain the construction compact and resistant against harmful environmental effects.

When a hard tactile feeling is desired feature, the keytops should be made of some hard component. Also it is advantageous that the protective cover portion is made of rigid material. According to the present invention, the keytops and the cover portion are made of a same selected substrate at the same time. In this application this selected material or substrate is generally called the rigid component. This rigid component could be for example acrylonitrilebutadienestyrene, polycarbonate, polypropylene, polystyrene, hard polyethylene, polyvinyl chloride or some other applicable plastic. Choice of the material also makes some requirements to the structure. The key material is selected to be rigid, which means, that there must be some elastic, flexible, non-rigid parts in the construction to able the keytop to move towards the cover portion. This requirement can be fulfilled with the relatively thin and elongated part 206 of the structure that connects the keytop portion to the cover portion. In some prior art solutions a spring is used to produce this elastic connection. According to present invention this is not possible, since the whole integrated keytop-cover-portion is to be made by one manufacturing step. Thus all parts included in this integrated construction are produced of the selected rigid component.

A keypad with several keys (or push-buttons) is introduced in FIG. 3. According to this one advantageous embodiment of the present invention keys 301, made of rigid component, are movable, even if the keys themselves are rigid. This is implemented so, that every key has one fastening element 303, which in this embodiment is called the leg, which connects the key portion to the cover portion. This leg is either moulded at the same time and made of the same material as the combined key-cover portion or manufactured separately so that in the assembled configuration it is attached to the corresponding key portion and the cover portion. It is also possible to manufacture legged key portions that are attached to the cover portion at the distant end of the leg. This leg is thin and planar, so its mechanical properties make it flexible. This kind of leg-structure is advantageous in keypads, which have number of keys, because this kind of construction enables the moulding to be done without any moving parts. As a consequence the number of manufacture steps is minimized and keypad can be produced effectively. After this first key-leg-cover-part is moulded or assembled, according to the invention, the second moulding with soft component is to be done.

The soft component is used to fill the circular gap around the key portion 302. This enables the key 301 (or button) to be pushed down for some action. When the gap around the key portion 302 is filled with soft material, it bends elastically with the movement of the key. Also this moving of the key 301 causes the wanted tactile feedback to the user. The soft component is then attached around the key portion 301 of the previously moulded piece. This soft component might be for example silicone rubber, soft polyethylene, soft polyamide or some thermoplastic elastomer (TPE). The thermoplastic elastomers are soft, flexible and commonly used instead of usual plastic for injection moulding and extrusion of soft flexible applications.

The key portion and the cover portion are not necessarily connected to each other at all. With different nozzles, keys may be injected so that they will not be in touch to each other or to the cover portion. In this embodiment of the present invention, the keys are kind of separate enclaves, until the soft component is injected. So the key portion, the cover portion and the soft component may all be fabricated by one mould, step by step, without any storage or handling in between. Also this minimizes the assembly steps of the production.

According to one advantageous embodiment of the present invention both rigid and soft component materials can be chosen to be polyamide 12 (PA12). Polyamide 12 can be used in a hard, rigid form and also in a soft, flexible form. This enables the both, rigid and soft components, to be produced of the same material. This is advantageous, because these materials fit together, so these are compatible. Also if the product is recycled afterwards, there is no need to separate these parts from each other. The rigid component is made, according to this advantageous embodiment, of polyamide 12 hard phase. For the soft component the same polyamide 12 is used as its soft phase. The soft component, here soft polyamide 12, is attached to the rigid component construction. Attaching of this soft component is described in the following in detail with the FIGS. 4*a* and 4*b*.

Figure 4A:
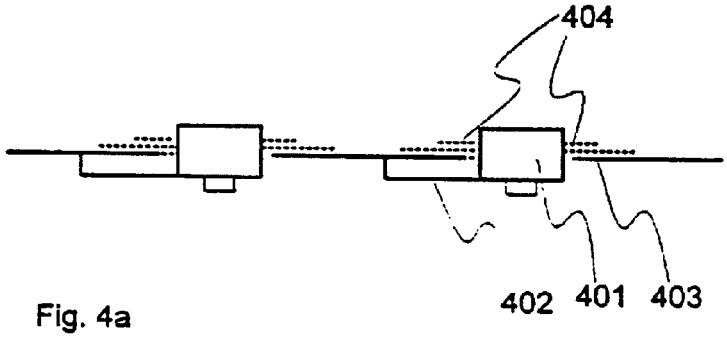
FIG. 4*a* illustrates a moulded keypad and attachment of the soft component according to advantageous embodiment of the invention.
Figure 4B:
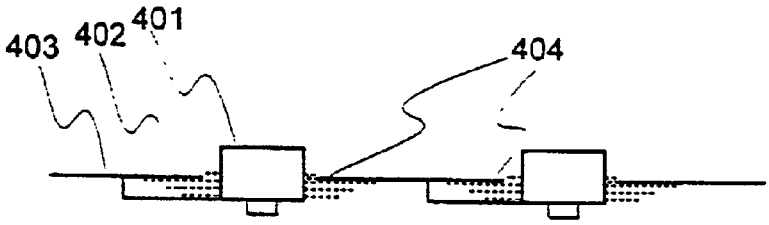
FIG. 4*b* illustrates a moulded keypad and attachment of the soft component according to other advantageous embodiment of the invention.

FIGS. 4*a* and 4*b* are examples of the possible implementations for attaching the soft component 404. In both figures the rigid component key structures are equal, including a keytop 401, a cover portion 403 as well as a fastening element 402, which combines the keytops 401 to the cover portion 403. The first integrated part is made in one manufacturing step, moulding the keys 401, cover 403 and the combining elements 402 all at the same time. According to one embodiment of the present invention, illustrated in FIG. 4*a*, the soft component 404 is attached to the upper side of the structure. This has the advantage, that some marks or characters can be printed on this area, either on top of the soft component or beneath it if the soft component is transparent or translucent. This enlarges the printing area, which leads to the elaborated and individualized marking of keys. The whole soft component area can be used to mark keys and add further graphics.

In FIG. 4*b* the soft component 404 is attached on the underside of the structure. The soft component is attached to the rigid component structure by pressing, moulding or injecting. Further the connection can be mechanical or chemical. Chemical connection is more resistant. For example if water resistance is required, the connection must be chemical. Although in many cases it is enough to have dust or moisture resist keypad, in which the mechanical connection can be used. Also if used materials are to be separated later for example for the recycling, the mechanical connection enables later separation of the components.

A cutless and compact keypad is advantageous especially, when the keypad is used and situated on table or on some other plane. Situations like this are the most likely to suffer from moisture and dirt or dust, which either impairs the functioning of the key or makes it unable to function.

According the present invention, only a key portion and a cover portion of a keypad are modified. The structure consisting of the rigid and soft components described above can be used to replace the known parts 106, 107 and 108 illustrated in FIG. 1. The invention does not concern any of the electrical functions behind the key-cover-portion presented in this application. The keypad might consist of an electrical switch or any other known construction and situation behind the key-cover-portion.

What is claimed is:

1. A keypad comprising a first component including a cover portion and a key portion forming together a single structural entity, said structural entity allowing the key portion to move within a limited range in relation to the cover portion; and a substantially soft second component attached to the first component for covering space between the cover portion and the key portion of the first component and making a construction of the composed compound of the first component and the second component substantially tight, still allowing the limited movement of the key portion of the first component.

2. A keypad according to claim 1, wherein the first component is rigid having interstices between the cover portion and the key portion for allowing the key portion to move within a limited range in relation to the cover portion.

3. A keypad according to claim 1, wherein the second component is on a keytop side of the construction made of the first component.

4. A keypad according to claim 1, wherein the second component is on a keybottom side of the construction made of the first component.

5. A keypad according to claim 1, wherein the first component is made of material, which is one of the following: acrylonitrilebutadienestyrene, polycarbonate, polypropylene, polystyrene, polyethylene, polyvinyl chloride, polyamide 12; and the second component is made of material, which is one of the following: silicone rubber, polyethylene, polyamide, thermoplastic elastomer, polyamide 12.

6. A keypad according to claim 1, wherein the limited movement of the key portion is enabled by coupling the key portion and the cover portion by a handle, which is reversibly bendable due to its mechanical properties based on its form and characteristics.

7. A keypad according to claim 1, wherein on a surface of the first component, which is essentially covered by the second component, there is a wrought protrusion essentially as thick as the second component, so that the protrusion reaches through the second component to a surface of the second component, which is intended for the use of a user.

8. A keypad according to claim 1, wherein the attachment between the first and the second components is mechanical.

9. A keypad according to claim 1, wherein the attachment between the first and the second components is chemical.

10. A method for making a keypad, comprising the steps of:

moulding a first component including a cover portion and a key portion, said cover portion and said key portion forming a single structural entity, wherein said key portion is arranged to move limitedly in relation to said cover portion; and attaching a substantially soft second component to the first component to cover a move-enabling space between said cover portion and key portion of the first component to make a construction of the composed compound of said first component and said second component substantially tight.

11. A method according to claim 10, wherein the step of moulding the first component and the step of attaching the second component are sequential steps and both steps are made with the one and the same mould.

12. A method according to claim 10, wherein the second component is attached to the construction made of the first component by moulding.

13. A method according to claim 10, wherein the second component is attached to the construction made of the first component by injecting.

14. A method according to claim 10, wherein the second component is attached to the construction made of the first component by pressing.

15. A method according to claim 10, wherein the second component is attached on a keytop side of the construction made of the first component.

16. A method according to claim 10, wherein the second component is attached on a keybottom side of the construction made of the first component.

17. A method according to claim 10, wherein the components are coupled mechanically to each other.

18. A method according to claim 10, wherein the components are coupled chemically to each other.

* * * * *